US005677018A

United States Patent [19]

Shin

[11] Patent Number: 5,677,018

[45] Date of Patent: Oct. 14, 1997

[54] CANDY TREE

[76] Inventor: Myung K. Shin, 172 Sangil-Dong, Kangdong-Ku, Hyundai Villa 8-302, Seoul, Rep. of Korea

[21] Appl. No.: 520,482

[22] Filed: Aug. 29, 1995

[51] Int. Cl.[6] ..... A47G 33/06

[52] U.S. Cl. ..... 428/18; 428/19

[58] Field of Search ..... 428/18, 19, 20; 493/956; D11/118

[56] References Cited

U.S. PATENT DOCUMENTS

| | | | |
|---|---|---|---|
| D. 163,517 | 6/1951 | Hansen | 428/7 X |
| 267,277 | 11/1882 | Strasser | 428/19 |
| D. 319,558 | 9/1991 | De Regt | D7/601 |
| D. 354,252 | 1/1995 | Smith et al. | D11/118 |
| 1,907,769 | 5/1933 | Favreav | 428/19 |
| 2,226,349 | 12/1940 | Royle | 428/19 |
| 2,565,700 | 8/1951 | Schiller | 428/19 |
| 2,851,807 | 9/1958 | Taylor | 428/19 |
| 2,865,122 | 12/1958 | Clawson | 428/19 |
| 3,127,302 | 3/1964 | Bunting | 428/18 X |
| 3,539,432 | 11/1970 | Chee | 428/7 X |
| 3,676,275 | 7/1972 | Sloane | 428/9 |
| 3,857,747 | 12/1974 | Bitecola | 428/18 X |
| 3,967,019 | 6/1976 | Magee | 428/19 X |
| 4,202,922 | 5/1980 | Osment | 428/18 |
| 4,333,974 | 6/1982 | Davis | 428/16 |
| 4,612,218 | 9/1986 | Enterline | 428/8 |
| 4,947,722 | 8/1990 | Lewis | 428/7 X |
| 4,966,793 | 10/1990 | Covell | 428/18 X |
| 5,244,700 | 9/1993 | Banschick | 428/4 |
| 5,280,682 | 1/1994 | Fussell | 40/409 |
| 5,380,568 | 1/1995 | Banschick | 428/4 |
| 5,386,909 | 2/1995 | Spector | 206/457 |

*Primary Examiner*—Henry F. Epstein
*Attorney, Agent, or Firm*—Steven Horowitz

[57] ABSTRACT

A candy tree with a conical shape having wrapped candies adhesively and removably attached thereon covering the entire surface of the plastic or styrofoam cone forming the principal part of the tree element. The remaining portion of the tree element is the semispherical rigid holder into which the cone snugly fits. The holder is generally obscured by the wrapped candies and its flat underside allows the candy tree to rest on any flat surface. The candy tree can be used for ornamental, decorative, amusement or religious purposes and permits individual candies to be removed by children. Various decorative elements, such as a ribbon, a miniature santa claus or a pumpkin can be inserted into the top end of the tree element.

20 Claims, 1 Drawing Sheet

CANDY TREE

This invention relates to miniature trees decorated with wrapped candies which are used in numerous applications including for ornamental, decorative, religious and amusement purposes.

It is known in the art to create whimsical figures by gluing wrapped candies to a figurine. For example, U.S. Pat. No. 4,333,974 to Davis discloses figurines covered with wrapped candies that are glued on to a styrofoam body to create whimsical human creatures. It is also known in the art to decorate the branches of trees with gum drops or similar confections. For example, U.S. Pat. No. 2,226,349 to Royle discloses a decorative tree wherein confections such as gum drops are pressed onto lugs in the branches of the tree for ornamental purposes. Similarly, U.S. Pat. No. 2,565,700 to Schiller discloses a sugar plum tree whose limb portions have impaled thereon ornamental and/or edible objects such as candied sugar plums or gum drops.

None of the above patents nor any others are known to provide a miniature tree that serves the dual purpose of providing a means for children to enjoy candy from a decorative object and as a decorative religious ornament for seasonal occasions.

OBJECTS

It is an object of the present invention to provide a candy tree in the shape of a miniature evergreen tree, i.e. substantially conical, that can be used for decorative, ornamental and religious purposes during the Halloween and X-Mas Holiday season and where the bottom of the candy tree contains a base that allows it to easily stand out its own on any flat surface.

It is an object of the present invention to provide a miniature candy tree that is decorated by removably attached wrapped candies covering the entire external conical shaped surface of the candy tree.

A further object of the present invention is to provide an ornamental holiday decoration that children can play with by removing candies from manually one by one.

SUMMARY OF THE INVENTION

To accomplish the above mentioned purposes, the candy tree of the present invention comprises three elements, the tree element, the holder and the candy element. The tree element itself consists principally of the cone. The cone is substantially conical in shape with the wider diameter found at the lower end. The external conical surface of the candy tree may be made of any suitable material such as plastic or foam. The lower portion of the tree element fits into the holder which consists of a hard plasticlike material surrounding the lower portion of the cone. The bottom of the holder is also substantially smooth and flat except for a circular protrusion so that the entire candy tree can rest of a table, floor or other flat surface.

The candy element consists of wrapped candies whose wrapping at each end is generally twisted at the edge of the candy. The candy element is attached to the tree element by glue or adhesive and is attached at enough points on the external conical surface of the tree portion so as to completely cover the surface.

The above mentioned objects and description will be more easily understood by reference to the following drawings.

DETAILED DESCRIPTION OF THE DRAWINGS

Figure 1:
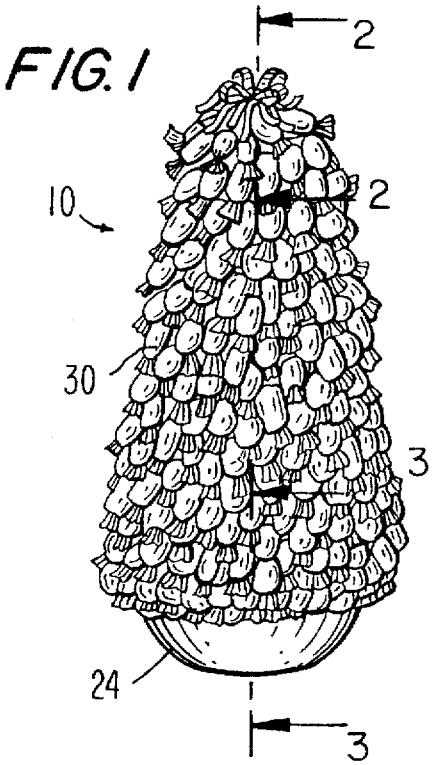
FIG. 1 is a perspective view of the candy tree of the present invention with wrapped candies attached.
Figure 2:
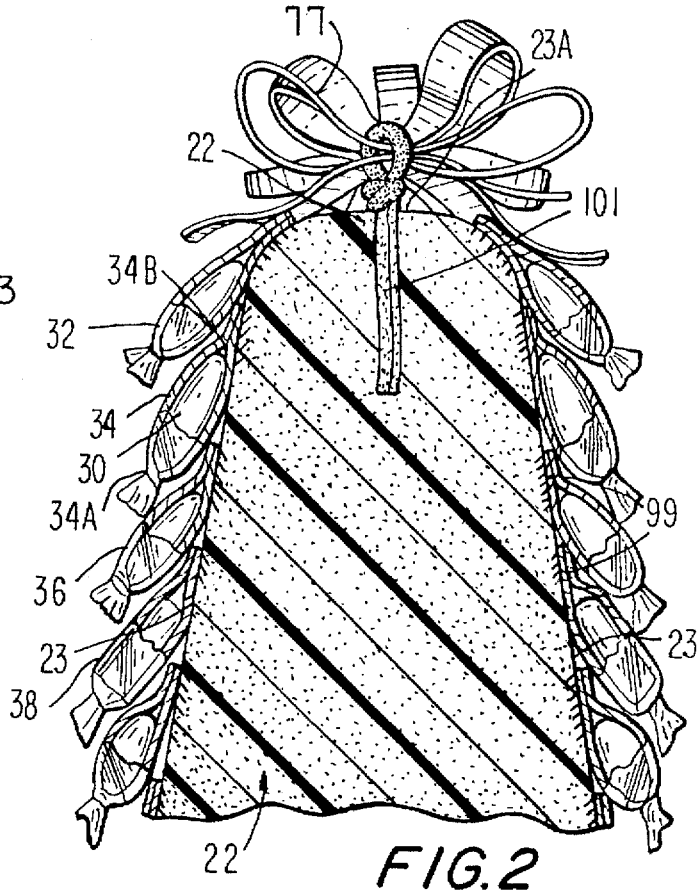
FIG. 2 is an enlarged cross-sectional view of the candy tree of the present invention taken along line 2—2 of FIG. 1.

As seen in FIGS. 1–2, candy tree 10 is composed of a tree element or cone 22, a holder 24 and a candy element 30. Tree element 22, as best seen in FIG. 2, is substantially shaped like a cone 22. Tree element 22 can be made of plastic from one unitary mold or from the kind of foam-like expanded rigid polystyrene plastic material sold under the trademark STYROFOAM. Ideally, tree element 22 should be made of material, like "STYROFOAM" brand expanded rigid polystyrene plastic, that is sufficiently porous that it can receive insertions of wire or other narrow hard materials for decorative purposes as will be explained below. Tree element 22 can also be made from a sufficiently strong paper material that can carry the weight of the candies without it falling apart.

Figure 3:
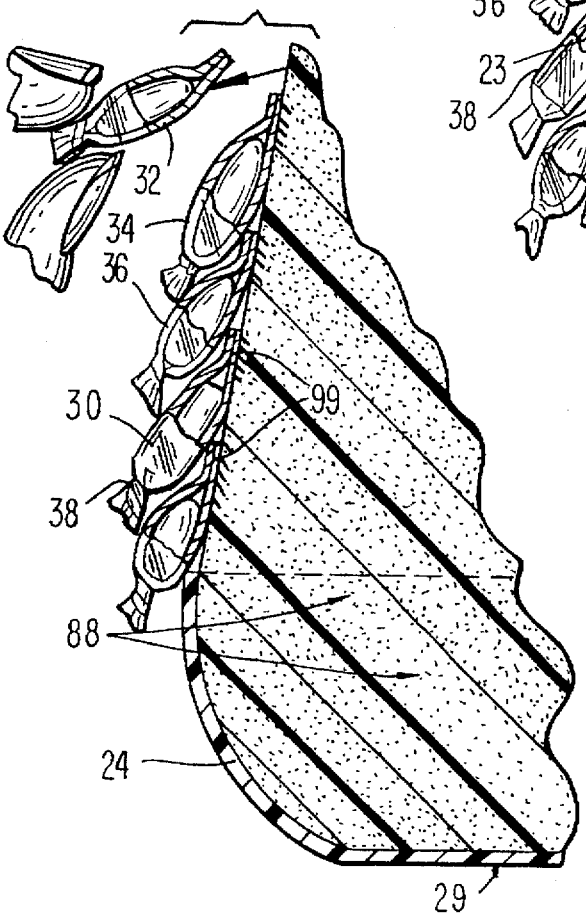
FIG. 3 is an enlarged cross-sectional view taken along line 3—3 of FIG. 1 showing a candy being removed from the candy tree of the present invention.

As best seen in FIGS. 2 and 3, cone 22 is substantially conical in shape with a generally flat bottom so that it can fit into a rigid holder. Cone 22 also has a substantially smooth external surface 23 to which adhesive 99 is applied when candies are attached so that candies can be removably attached thereto. The adhesive 99 should be strong enough to permit portability of candy tree 10 without candies falling off the surface 23 of cone 22 but not so strong that the wrapped candies, once attached, cannot be removed by a child. Cone 22 tapers off at its top end to a generally rounded point 23A. In order to increase the attractiveness of candy tree 10, as seen in FIG. 2, there may be a decorative ornament such as ribbon 77 on top of cone 22. The ribbon 77 or other decoration can be attached to cone 22 by insertion into the cone 22 of an elongated wire 101 with a fuzzy surface such as is used in pipe cleaners. This wire attachment means 101 is also attached to the ribbon or other decoration at one end. As an alternative decoration that may be used on top of cone 22 or even as an additional decoration is a miniature santa claus which would be appropriate for the X-mas season and would similarly attach to the cone by wire attachment means 101 that would form part of or attach to the miniature santa claus figure. Alternatively, a miniature pumpkin can be placed on top of cone 22 as a decoration for the Halloween season.

The holder 24, as seen in FIG. 1 of the drawings, of tree element 22 consists of a substantially hemispherical or bow shaped hard plastic material into which the lower portion 88 of cone 22 fits snugly. The holder 24 can also be made from any other hard but lightweight material such as wood, rubber, aluminum (or other lightweight metal) or cork. Accordingly, the diameter of the holder 24 is necessarily very slightly greater than that of the bottom portion 88 of cone 22. The underside 29 of holder 24 is flat and smooth so that the entire candy tree 10 can rest of a table, floor or other flat surface. Alternatively, the underside 29 of holder 24 may be flat except that it has a circular protrusion to increase the stability of the candy tree 10 in rest position.

The candy element 30 consists of wrapped candies, e.g. 32, 34, 36, 38 whose wrapping at each end thereof is twisted at the edges, e.g. 34A, 34B, of the candy as is standard for such candies. The candies can obviously be hard candies or soft candies of any edible kind although the typical shape is substantially oval. The candy element 30 is attached to the tree element 22 by glue or adhesive that into which the candies had been dipped or the adhesive 99 had been placed on cone 22. Enough wrapped candies of candy element 30 are attached to cone 22 at enough points on its external conical surface 23 so as to completely cover the surface 23. In addition, wrapped candies attached to the lowest visible portion 26 of cone 22 hang down sufficiently over holder 24 to obscure the view of most of holder 24. On the other hand, holder 24 can be grasped cleanly by one's hands to transport candy tree 10 since no candies are actually attached to the holder 24.

When in use, candy tree 10 is placed on a flat surface either for viewing as an ornamental decoration for December and January Holidays or otherwise. In addition, the candy tree 10 can be placed within the reach of children who can also enjoy the candy tree 10 by pulling off particular wrapped candies as they desire from the candy tree 10.

What is claimed is:

1. A decorative candy tree comprising (i) a conically shaped miniature tree element of soft lightweight material that has a smooth external surface for attachment of wrapped candies and that tapers at its top narrow end to a rounded point, (ii) a rigid holder surrounding and encasing a lower portion of the tree element and having a substantially flat and smooth underside for supporting the entire candy tree and (iii) a candy element comprised of wrapped candies each of which is removably attached by adhesive at one end to the surface of the tree element and which includes candies adhered to a lowest visible portion of the tree element that overhang the holder so as to obscure the visibility of most of said holder, said candy element covering the entire tree element.

2. The candy tree of claim 1, wherein the soft lightweight material is a plastic and the tree element is made out of a single contiguous plastic form.

3. The candy tree of claim 1, wherein the soft lightweight material is an expanded rigid polystyrene plastic.

4. The candy tree of claim 1, wherein the soft lightweight material is paper.

5. The candy tree of claim 1, wherein a decoration is attached to the top narrow end of the tree element.

6. The candy tree of claim 1, wherein a decoration is attached to the top narrow end of the tree element by inserting an elongated rigid element attached to the decoration into said tree element.

7. The candy tree of claim 1, wherein the soft lightweight material is a material selected from the group consisting of plastic and paper and wherein a decoration is attached to the top narrow end of the tree element.

8. The candy tree of claim 1, wherein the soft lightweight material is a material selected from the group consisting of plastic and paper and wherein a decoration is attached to the top narrow end of the tree element by inserting an elongated rigid element attached to the decoration into said tree element.

9. A decorative candy tree comprising (i) a conically shaped miniature tree element made of soft lightweight material that has a smooth external surface for attachment of wrapped candies and that tapers at its top narrow end to a rounded point, (ii) a rigid holder surrounding and encasing a lower portion of the tree element and having a substantially flat and smooth underside for supporting the entire candy tree and (iii) a candy element comprised of wrapped candies each of which is removably attached by adhesive at one end to the surface of the tree element, said candy element covering the entire tree element.

10. The candy tree of claim 9, wherein the soft lightweight material is a plastic and the tree element is made out of a single contiguous plastic form.

11. The candy tree of claim 9, wherein the soft lightweight material is a polystyrene foam material.

12. The candy tree of claim 9, wherein the soft lightweight material is paper.

13. The candy tree of claim 9, wherein a decoration is attached to the top narrow end of the tree element.

14. The candy tree of claim 9, wherein a decoration is attached to the top narrow end of the tree element by inserting an elongated rigid element attached to the decoration into said tree element.

15. The candy tree of claim 9, wherein the soft lightweight material is a material selected from the group consisting of plastic and paper and wherein a decoration is attached to the top narrow end of the tree element.

16. The candy tree of claim 9, wherein the soft lightweight material is a material selected from the group consisting of plastic and paper and wherein a decoration is attached to the top narrow end of the tree element by inserting an elongated rigid element attached to the decoration into said tree element.

17. A decorative candy tree comprising (i) a conically shaped miniature tree element of soft lightweight material that has a smooth external surface for attachment of wrapped candies and that tapers at its top narrow end to a rounded point, (ii) a rigid bowl-shaped holder surrounding and encasing a lower portion of the tree element and having a substantially flat and smooth underside for supporting the entire candy tree and (iii) a candy element comprised of wrapped candies each of which is removably attached by adhesive at one end to the surface of the tree element and which includes candies adhered to a lowest visible portion of the tree element that overhang the holder so as to obscure the visibility of most of said holder, said candy element covering the entire tree element.

18. The candy tree of claim 17, wherein the soft lightweight material is a plastic and the tree element is made out of a single contiguous plastic form.

19. The candy tree of claim 17 wherein a decoration is attached to the top narrow end of the tree element by inserting an elongated rigid element attached to the decoration into said tree element.

20. The candy tree of claim 17, wherein the soft lightweight material is a material selected from the group consisting of plastic and paper and wherein a decoration is attached to the top narrow end of the tree element by inserting an elongated rigid element attached to the decoration into said tree element.

* * * * *